United States Patent [19]

Bogar

[11] Patent Number: 4,854,106

[45] Date of Patent: Aug. 8, 1989

[54] CLIP AND SPACER FOR REINFORCING RODS

[76] Inventor: Bela Bogar, 12 Collings Street, Pearce, Act, 2607, Australia

[21] Appl. No.: 214,898

[22] Filed: Jun. 29, 1988

Related U.S. Application Data

[63] Continuation of Ser. No. 6,955, Jan. 27, 1987, abandoned.

[51] Int. Cl.[4] ..... E04C 5/16

[52] U.S. Cl. ..... 52/719; 52/686

[58] Field of Search ..... 52/677, 680, 684–686, 52/719

[56] References Cited

U.S. PATENT DOCUMENTS

| | | | |
|---|---|---|---|
| 1,625,839 | 4/1927 | White | 52/686 |
| 3,673,753 | 7/1972 | Anderson | 52/680 |
| 3,895,470 | 7/1975 | Würth | 52/686 |

FOREIGN PATENT DOCUMENTS

| | | | |
|---|---|---|---|
| 2035670 | 1/1972 | Fed. Rep. of Germany | 52/719 |
| 371839 | 4/1932 | United Kingdom | 52/686 |

*Primary Examiner*—David A. Scherbel
*Assistant Examiner*—Caroline D. Dennison
*Attorney, Agent, or Firm*—Balogh, Osann, Kramer, Dvorak, Genova & Traub

[57] ABSTRACT

This invention describes foundations for buildings and like structures employing steel reinforcement. The invention describes a hook leg having an elongate member bifurcated at each end longitudinally of the member to form a pair of extensions with a slot therebetween, the distal portions of the extensions being bent into a curved form extending transversely of the member to form hooks adapted to resiliently engage a pair of reinforcing rods in the reinforcement, the slots in the unbent portions of the extensions being adapted to receive a second pair of reinforcing rods extending transversely of the first pair, whereby to fix the rods in spaced alignment. The invention minimizes movement or collapse of the reinforcement and makes it much easier to assemble the foundation cage thereby saving in labor and material.

1 Claim, 4 Drawing Sheets

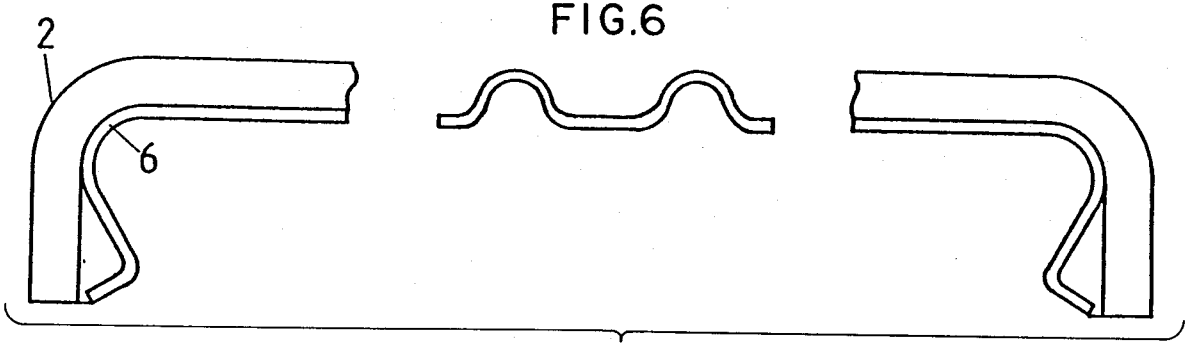
FIG.6
FIG.5
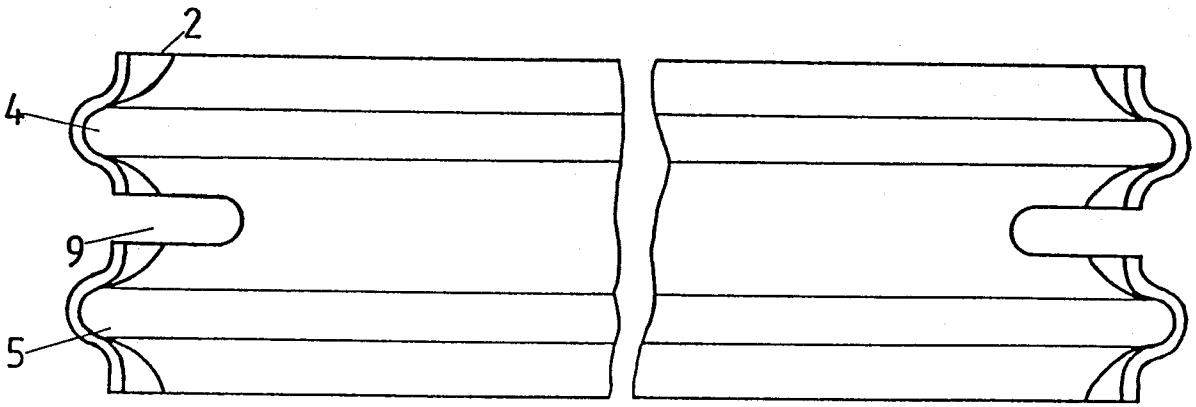
FIG.7

CLIP AND SPACER FOR REINFORCING RODS

This application is a continuation of application Ser. No. 006,955 filed Jan. 27, 1987, now abandoned.

FIELD OF THE INVENTION

This invention relates to foundations for buildings and other structures e.g. retaining walls. For the sake of brevity it will be described with relation to foundations for houses, although it is to be understood that its application is not so limited.

DESCRIPTION OF THE PRIOR ART

The current practice is to interconnect the two layers of trench mesh by use of supporting stirrups, also known as legs, necessitating 4–5 tie wire connections at each stirrup location. Trench mesh chairs can also be used, however, this requires the mesh to be specially cut. Foundation reinforcements assembled with the above current methods are not sufficiently firm to stand up to forces associated with the subsequent concrete pour. They often completely collapse and as a result reinforcement is totally exposed for corrosion and can eventually be the cause of foundation failure. This causes movement and cracks in a building and often irreparable damage occurs.

SUMMARY OF THE INVENTION

This invention is designed to overcome these deficiencies and improve structural efficiency of house foundations, i.e. the invention provides a device called hereinafter a 'hook leg' which is simple yet extremely effective component which merely hooks in at both ends of the leg at the normally spaced distance on the trench mesh and braces it to a very rigid position which clamps on to the trench mesh. Movement or collapse of the reinforcement is almost totally eliminated. In addition, it is much easier to assemble the required cage and a substantial saving in labor and material Broadly speaking, the invention comprises a hook-leg for use in steel reinforcement for concrete structures comprising an elongate member bifurcated at each end longitudinally of the member to form a pair of extensions with a slot there between, the distal portions of said extensions being bent into a curved form extending transversely of said member to form hook means adapted to resiliently engage a pair of reinforcing rods in said reinforcement, the slots in the unbentt portions of said extensions being adapted to receive a second pair iof reinforcing rods extending transversely of said first pair, whereby to fix said rods in spaced alignment.

BRIEF DESCRIPTION OF THE DRAWINGS

Further advantages and objects of my invention will become clearer from a consideration of the accompanying drawings in which:

FIGS. 5, 6 and 7 show details of the hook leg (FIG. 6 being along section A—A of FIG. 5 and 7 being a plan of FIG. 5)

DETAILED DESCRIPTION

Figure 2:
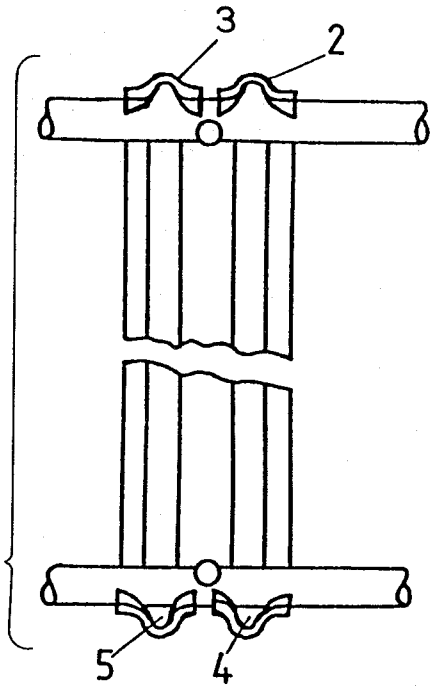
FIGS. 1 and 2 show the general arrangement of the hook leg.
Figure 1:
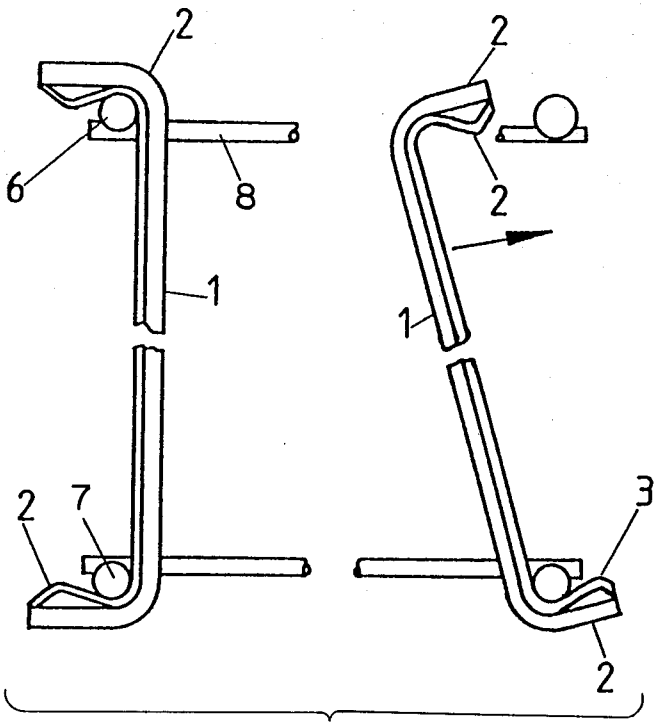
Figure 3:
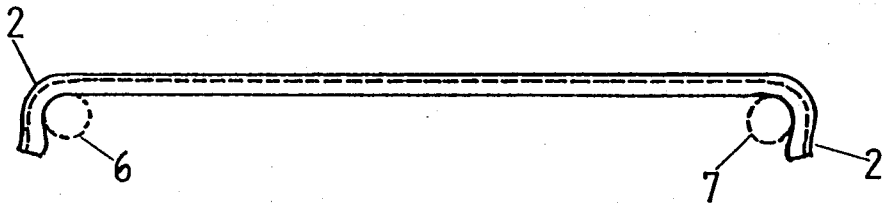
FIGS. 3 and 4 show a different view thereof.
Figure 4:
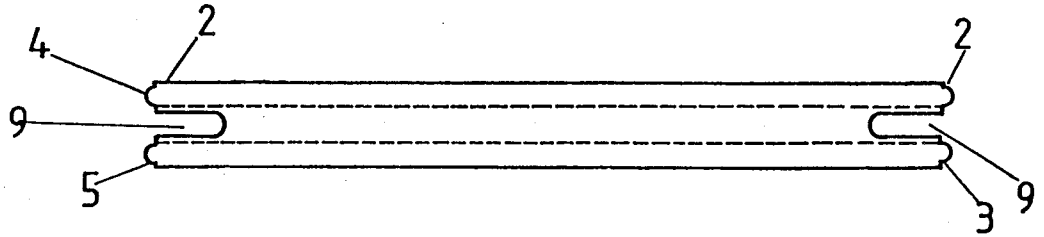
Figure 8:
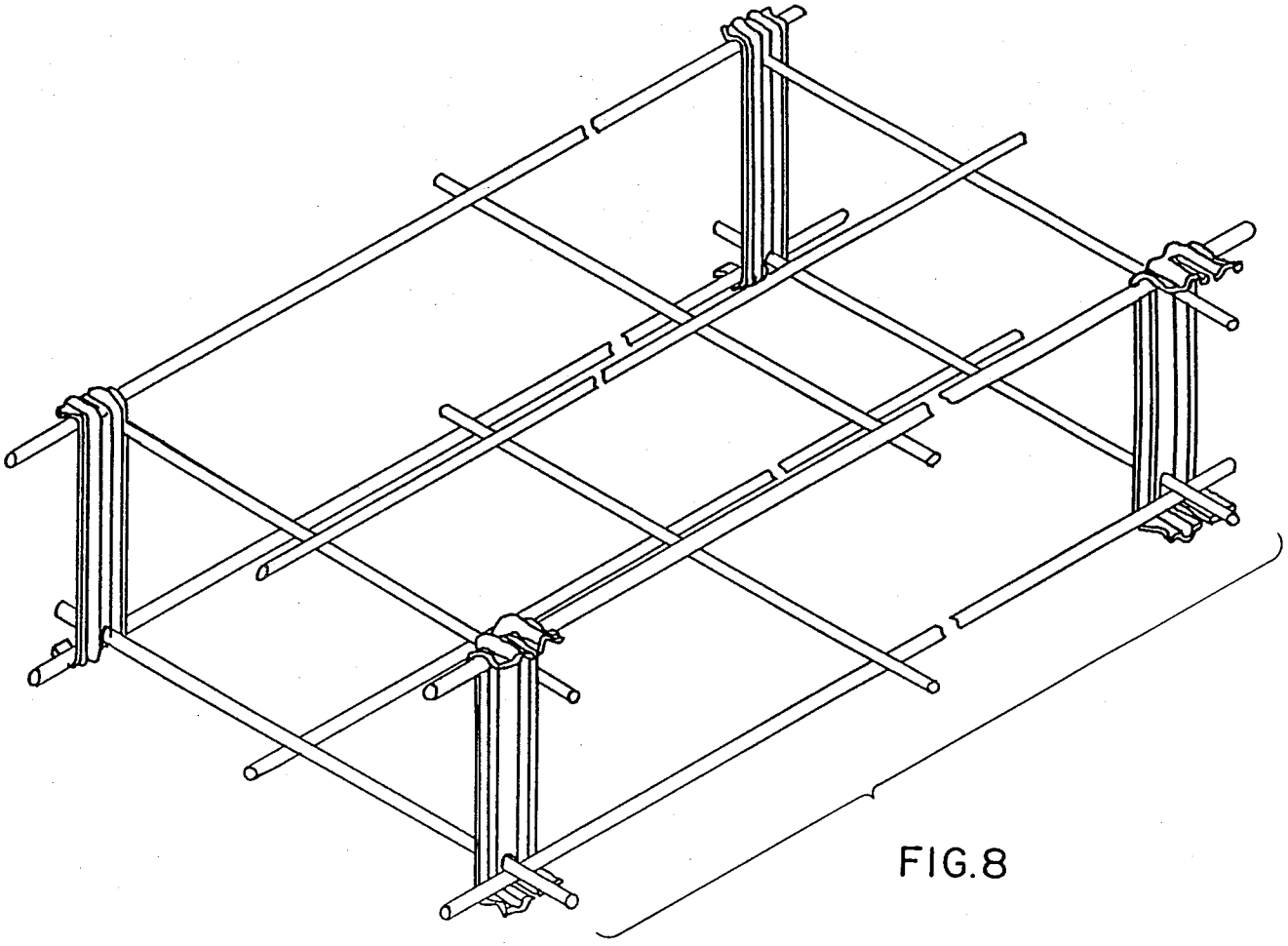
FIG. 8 shows a foundation mesh assembly incorporating the hook leg.

The hook leg 1 may be made from steel strap as indicated and at each end is bifurcated to form a pair of resilient hooks 2 and 3, respectively grooved, as at 4, 5. As illustrated in FIG. 1, the hook leg can be rotated about the reinforcing rods to clip resiliently into position over rods 6, 7 and 8. Note that rods 8 are caught in the bifurcation 9 and trapped at their ends under rods 6 and 7. Thus a firm and stable structure can be built up, as illustrated in FIG. 8. The grooves in the hook leg are suitable for receiving and locating other rods as required.

It is emphasised that the present invention embraces the hook leg which is considered to be novel per se and also includes within its scope foundations using the hook leg and buildings having foundations incorporating the hook leg.

Finally, it may be noted that the present invention is to be given a broad connotation and is not limited to the specific embodiments described.

I claim:

1. A unitary clip device for spacing and securing reinforcing rods which are used in concrete construction, comprising an elongated member having a flat central elongated portion flanked by elongated margin portions formed with reinforcing ribs, the extremities of said central portion being undercut to define a bifurcation formed by extending extremities of said margin portions, the distal extremities of said margin portions defining pairs of ribbed hooks spaced by said bifurcations which receive a first reinforcing rod, said ribbed hooks extending out of the plane of said member in a common direction, said bifurcations adapted to receive a second reinforcing rod.

* * * * *